US005664954A

United States Patent [19]

Rea et al.

[11] Patent Number: 5,664,954

[45] Date of Patent: Sep. 9, 1997

[54] SPARK PLUG BOOT ASSEMBLY

[75] Inventors: Michael Wayne Rea, Salem; Vincent James Tura, Jr., Niles, both of Ohio

[73] Assignee: General Motors Corporation, Detroit, Mich.

[21] Appl. No.: 623,210

[22] Filed: Mar. 28, 1996

[51] Int. Cl.[6] ..... H01R 13/44

[52] U.S. Cl. ..... 439/125; 439/595

[58] Field of Search ..... 439/125–128, 439/595

[56] References Cited

U.S. PATENT DOCUMENTS

| | | | |
|---|---|---|---|
| 4,715,337 | 12/1987 | Bohl et al. | 439/125 |
| 4,997,380 | 3/1991 | Etienne et al. | 439/127 |
| 5,127,840 | 7/1992 | Bezusko et al. | 439/127 |
| 5,409,388 | 4/1995 | Phillips, Jr. et al. | 439/125 |

FOREIGN PATENT DOCUMENTS

| | | |
|---|---|---|
| 817034 | 7/1959 | European Pat. Off. . |
| 225190 | 6/1987 | European Pat. Off. . |

*Primary Examiner*—Gary F. Paumen

*Attorney, Agent, or Firm*—Michael J. Bridges

[57] ABSTRACT

A spark plug boot assembly providing for simplified assembly of a tubular boot and an ignition cable having a terminal with a circumferential rib or protuberance thereabout, wherein the tubular boot includes a plurality of aligned bottom stops spaced along the longitudinal boot axis from a plurality of aligned flexible arms reaching into a central boot bore, with a bi-directional locking position formed between the bottom stops and the flexible arms for locking, upon full insertion of the ignition cable through the bore, the rib or protuberance in the locking position.

9 Claims, 2 Drawing Sheets

SPARK PLUG BOOT ASSEMBLY

FIELD OF THE INVENTION

This invention relates to automotive spark plug boots and, more particularly, to an apparatus for securing an ignition cable within a spark plug boot.

BACKGROUND OF THE INVENTION

Various assembly proposals have been made for securing automotive ignition cables within spark plug boots. For simplicity, push-to-seat and pull-to-seat assembly procedures are commonly used, in which, in a first assembly step, the ignition cable is pushed or pulled through the boot until a cable end terminal contacts a forward or a backward stop within the boot. The top of the boot is then glued to the cable in a second assembly step, to prevent reverse motion of the cable through the boot. The second assembly step adds cost and complexity to the assembly procedure.

To avoid such second step, a twist-to-lock assembly procedure has been proposed in which the ignition cable is, in a first step, inserted through the boot until a cable end terminal contacts a backward stop within the boot and then, in a second step, the boot is rotated relative to the ignition cable a predetermined rotational displacement to a position providing for bi-directional locking between the cable and the boot. Such second step again adds cost and complexity to the overall procedure and requires a departure from standard assembly procedures, reducing procedure efficiency and ease of assembly. Additionally, such proposed twist-to-lock procedure is subject to reliability shortcomings. A locking position requires proper rotational displacement. The boot can only be rotated when then cable is substantially engaged with the backstop and then does not lock until the proper degree of rotation is provided and maintained.

It would therefore be desirable to provide for bi-directional position assurance of an ignition cable and spark plug boot through standard assembly procedures with a minimum number of steps and with high reliability.

SUMMARY OF THE INVENTION

The present invention is directed to an apparatus for reliably, bi-directionally securing ignition cables to spark plug boots, supporting assembly of ignition cables and spark plug boots in one standard assembly step.

More specifically, for assembly with an ignition cable having a circumferential rib or protuberance with a top and bottom edge, a spark plug boot is provided with a bore therethrough, the bore having a plurality of aligned bottom stops for engaging the top edge of the rib, the bore further having a plurality of aligned flexible engaging means spaced from the plurality of bottom stops along the longitudinal axis of the bore to engage the bottom edge of the rib. Depending on the orientation of the plurality of bottom stops and the plurality of flexible engaging means, a standard push-to seat procedure or a standard pull-to seat procedure is applied during assembly to push or pull, in a single step, the ignition cable through the bore until the rib is at a bi-directional locking position within the bore intermediate the plurality of bottom stops and the plurality of flexible engaging means. The rib will not engage the bottom stops until such locking position is reached, for ease of assembly and for assembly reliability through position assurance feedback. Additional assembly steps, such as gluing steps or relatively complex rotational boot manipulation steps are not required to assure a locking engagement of the cable and boot.

In accord with a further aspect of this invention, the plurality of engaging means comprise a plurality of spaced tangs or flexarms that extend inwardly at an angle from an interior boot wall into the bore of the spark plug boot. As the rib passes the plurality of tangs, the tangs flex outwardly toward the interior boot wall. When the rib passes the tangs, the tangs snap back away from the interior boot wall to a locking position, such as against the outer body of an ignition cable terminal. As the rib passes further through the bore of the boot, a top edge of the rib engages the plurality of bottom stops which are constructed of a rigid material to prevent further cable displacement along the bore. Cable displacement in a reverse direction is likewise resisted by engagement of the rib with a bottom edge of the plurality of tangs.

In accord with yet a further aspect of this invention, the plurality of tangs and bottom stops are made of the material of the boot itself, such as a thermoplastic polyester resin material and are molded in a single process. Still further, a substantial spacing is provided along the longitudinal axis of the boot between the bottom edge of the plurality of tangs and the plurality of bottom stops to provide for ease of construction of the boot, with the circumferential rib constructed with a longitudinal cross-section corresponding to such substantial spacing.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
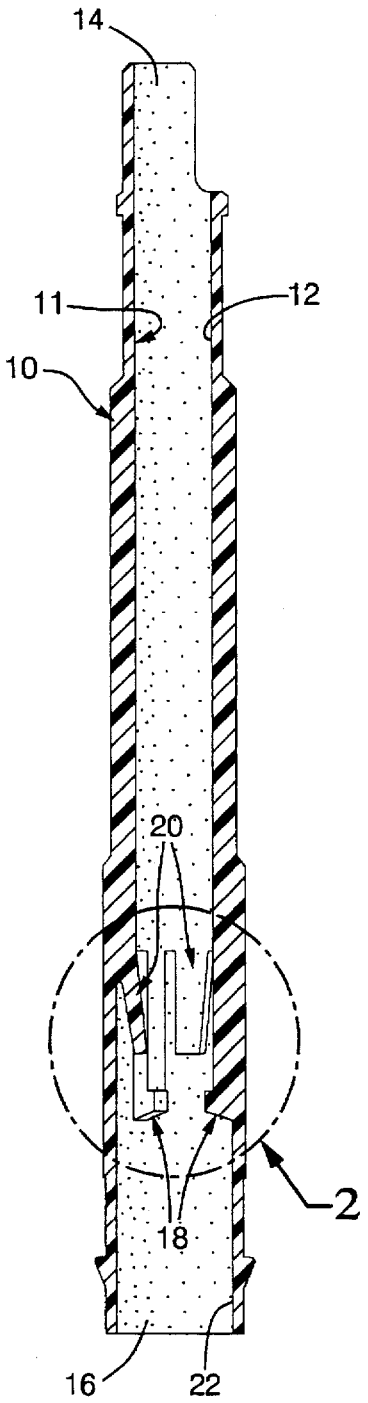
FIG. 1 is a front cutaway view of the spark plug boot of the preferred embodiment.

Referring to FIG. 1, a spark plug boot 10 of a hollow cylindrical shape and made from a thermoplastic polyester resin material PET of thirty percent glass filled polyester illustrates features of the preferred embodiment of this invention. A central bore 11 extends through the boot 10. At an upper end of the boot, the central bore 11 forms a first aperture 14 for receiving an ignition or spark plug cable (not shown) in a standard push-to seat assembly procedure. At a lower end of the boot opposing the upper end, the central bore 11 forms a second aperture 16 for receiving a spark plug. An upper interior wall 12 of the boot is sized to receive the ignition cable. A lower interior wall 22 of the boot is sized and constructed in any conventional manner to securely receive a spark plug wherein a seal is formed between the wall 22 and the plug to prevent passage of moisture and contaminants through the lower aperture 16 and past the spark plug.

Figure 2:
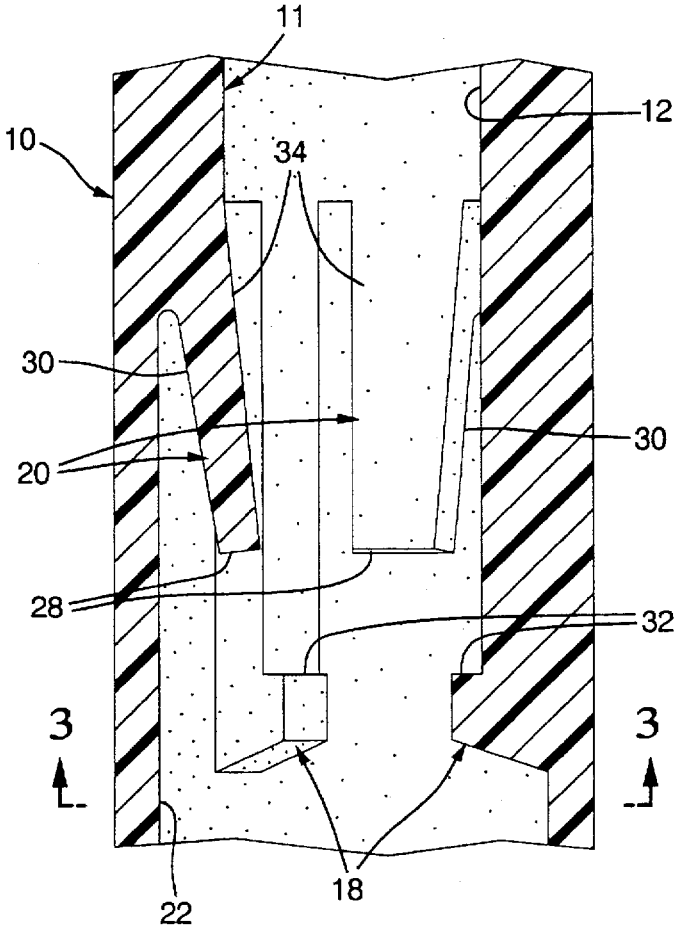
FIG. 2 is an enlarged view of the portion of FIG. 1 within reference circle 2.

As illustrated in FIG. 1 and further detailed in FIG. 2 which is an enlarged view of the section of the boot 10 of FIG. 1 within circle "2," a plurality of rigid bottom stops 18 are spaced about the circumference of the interior wall 12 and extend outward from the interior wall into the central bore 11. The bottom stops have an upper edge or lip 32 (FIG.

2) for engaging, at an ignition cable engagement position, a circumferential rib on the ignition cable to arrest further downward displacement of the ignition cable along the central bore 11 past the ignition cable engagement position. The bottom stops 18 may be made of common PET material, such as the described PET material of the boot 10.

Spaced from the plurality of bottom stops 18 along the longitudinal axis of the boot 10 is a plurality of tangs or flexarms 20 extending outward from the interior wall 12 in a downward direction and spaced from each other about the circumference of the interior wall 12. Each of the plurality of tangs 20 has a flat inner face 34 and a flat outer face 30 co-terminating in a flat edge 28 (FIG. 2). The inner face 34 of each tang 20 graduates into the upper interior wall 12 and the outer face 30 of each tang 20 terminates at the lower interior wall 22.

The tangs 20 are made of a common PET material, such as that of the boot 10 with, in this embodiment, a tapered cross-section providing for outward tang deflection in response to contact between the circumferential rib of the ignition cable (to be described) and the tangs 20 during a standard assembly procedure, such as a standard push-to-seat or pull-to-seat assembly procedure of the ignition cable and the boot 10. The tangs 20 are constructed to be resilient such that as the circumferential rib passes below the bottom edge 28 of the tangs, the tangs snap back from their deflection position toward the rest position of the tangs illustrated in FIGS. 1 and 2, as will be further described.

Figure 3:
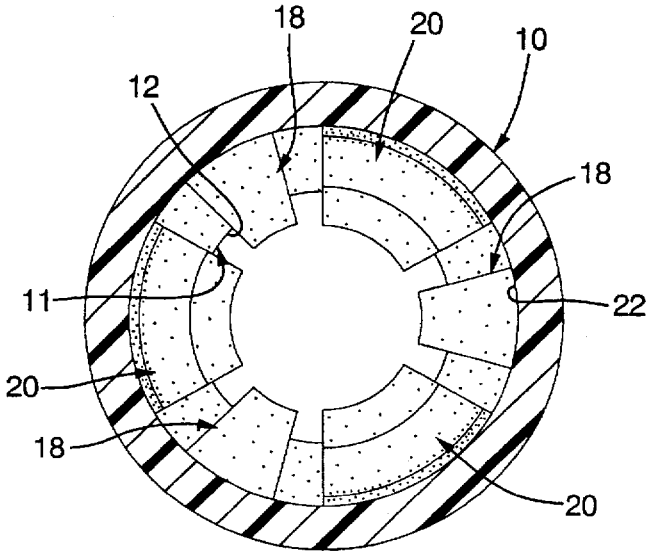
FIG. 3 is a bottom cutaway view of the spark plug boot of FIG. 1 taken along reference 3—3.

Referring to FIG. 3, a bottom view of the boot 10 taken along reference 3—3 illustrates the circumferential arrangement of the plurality of tangs 20 and the plurality of bottom stops 18 about the interior wall 12 of the boot 10. In this embodiment, three flexible tangs are spaced substantially equi-angularly about the interior wall 12 and extend into the central bore 11. Likewise, three rigid bottom stops 18 are spaced substantially equi-angularly about the interior wall 12 and extend into the central bore 11. In one embodiment, the tangs extend along a sixty degree arc length of the central bore 11, the bottom stops are spaced from the tangs by about fifteen degrees and extend along a thirty degree arc length of the central bore 11.

Figure 4:
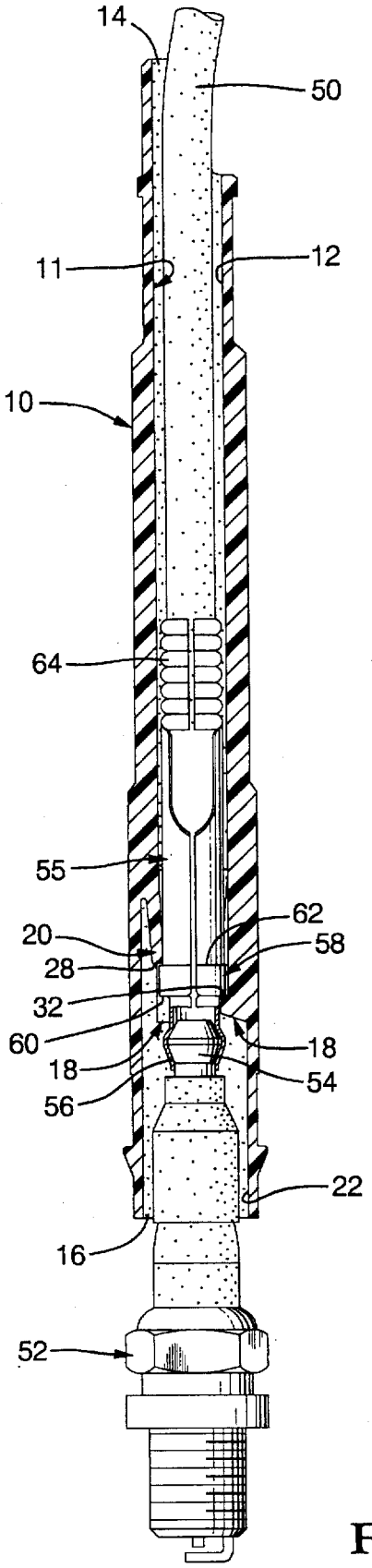
FIG. 4 is a front cutaway view of an installation of an ignition cable assembly within the spark plug boot of FIG. 1 seated on a spark plug in accord with the preferred embodiment.

Referring to FIG. 4, an assembly of boot 10 of the preferred embodiment with a spark plug 52 and ignition cable 50 illustrates bi-directionally secure engagement of the boot 10 with the ignition cable having a circumferential rib or protuberance 58 with a rib top edge 62 and a rib bottom edge 60. The ignition cable 50 is of any conventional design, such as a high energy T.V.R.S. cable with a non-metallic conductive core and a high temperature silicone insulating jacket.

A conductive socket terminal 55 includes a upper portion 64 which is crimped to the cable 50 to electrically engage the conductive core thereof and a socketed lower portion 56 opposing the upper portion 64 for electrically engaging spark plug terminal 54. The spark plug 52 is sealingly inserted into the second aperture 16 against lower wall 22. The assembly of the ignition cable 50 into the spark plug boot 10 of FIG. 4 is provided through a single step standard push-to-seat procedure in this embodiment in which socketed lower portion 56 of the cable 50 is first inserted through the upper aperture 14 and pushed through the central bore 11 until the circumferential rib or protuberance 58 contacts the plurality of tangs 20.

As the cable 50 is further inserted through the bore 11, the rib 58 engages the plurality of tangs 20 and drives such plurality outward toward the lower interior wall 22 until the rib top edge 62 passes the bottom edge 28 of the tangs 20, causing the tangs to snap back to a restraining position at which the outer face 34 of each of the tangs urgingly rests against the socket terminal 55 or at which the tangs are in a steady state position, such as the position illustrated in FIGS. 1 and 2. Reverse motion of the ignition cable 50 relative to the boot 10, which may further be described as motion in a direction opposing the described push-to-seat direction, is then resisted by engagement of the bottom edge 28 of the tangs 20 against the rib top edge 62. Such engagement of the tangs 20 and the rib top edge 62 results in an engagement force having a significant engagement force component along the longitudinal axis of the tangs 20. The tangs are substantially inflexible along the direction of such an engagement force component, providing for significant resistance to reverse motion of the fully inserted ignition cable 50 relative to the boot 10.

Further insertion of the ignition cable 50 through the central bore 11 leads to engagement of the rib bottom edge 60 with the upper edge 32 of each of the plurality of bottom stops 18. Further insertion of the ignition cable 50 is thereby restrained, providing for forward insertion motion resistance. The spacing between the upper edge 32 of the plurality of bottom stops 18 and the bottom edge 28 of the plurality of tangs 20 along the longitudinal axis of the boot 10 should be slightly greater than the height of the circumferential rib or protuberance 58 including the rib top and bottom edges, 62 and 60, respectively, thereof, to account for manufacturing tolerances. Such spacing should otherwise be minimized so that the cable 50-boot 10 assembly may be installed with the spark plug 52 with minimum allowed longitudinal motion of the cable 50 within the boot. The rib 58 height (from top edge 62 to bottom edge 60) should be designed to provide for a significant spacing along the longitudinal axis of the boot 10 between the edge 28 of the plurality of tangs 20 and the edge 32 of the bottom stops, for simplified boot manufacture.

Several alternative embodiments within the scope of this invention are envisioned by the inventors. For example, the described push-to-seat assembly arrangement may, through the exercise of ordinary skill in the art, be re-configured to provide for a pull-to-seat assembly arrangement simply by "swapping" the tangs and the bottom stops of FIGS. 1–4. More specifically, with reference to FIG. 4, the plurality of tangs 20 may be reversed in orientation so that they are pointing in an upward direction toward the aperture 14 and the plurality of bottom stops 18 may likewise be reversed in orientation so that the bottom edges 32 thereof are facing the edge 28 of the reversed plurality of tangs 20.

The plurality of tangs are then placed generally in the position of the plurality of bottom stops 18 and the plurality of bottom stops 18 are likewise placed generally in the position of the plurality of tangs 20. Assembly of the cable 50 with the boot 10 (FIG. 4) is then provided by pulling the cable up through the central bore 11 from the lower aperture 16 to the upper aperture 14 with the socket terminal passing through the bore 11 last, until the bi-directional locking position described for FIG. 4 is reached.

Still further, the number, general shape and arrangement about the circumference of the interior walls 12 and 22 of the tangs and bottom stops may be varied through the exercise of ordinary skill in the art without departing from the scope of the invention.

The preferred and alternative embodiments for the purpose of explaining this invention are not to be taken as limiting or restricting the invention since many modifications may be made through the exercise of ordinary skill in the art without departing from the scope of the invention.

The embodiments of the invention in which a property or privilege is claimed are described as follows:

1. A spark plug boot assembly for receiving an ignition cable terminating in a terminal circumscribed by a protuberance, and for bi-directionally securing the ignition cable terminal within the assembly, the assembly comprising:

a hollow boot having an interior surface surrounding a central bore;

a plurality of aligned tangs spaced about the interior surface, each of the plurality having a base portion attached to the interior surface of the boot and having a body portion extending at an angle from the corresponding base portion into the central bore and terminating in an end portion opposing the base portion;

a plurality of bottom stops spaced about the interior surface of the boot and aligned at a first position along the longitudinal axis of the boot, the plurality of bottom stops extending into the central bore;

the end portion of the plurality of tangs aligned at a second position along the longitudinal axis of the boot spaced a predetermined length from the first position; and wherein the predetermined length exceeds the width of the protuberance, thereby providing a bi-directional protuberance locking position between the first and second positions wherein insertion of the ignition cable into the central bore sufficient to locate the protuberance between the first and second locking positions provides for substantially a bi-directional locking engagement of the ignition cable within the boot.

2. The spark plug boot assembly of claim 1, wherein the hollow boot, the plurality of tangs, and the plurality of bottom stops are molded from a thermoplastic polyester resin material.

3. The spark plug boot assembly of claim 1, wherein the plurality of rigid bottom stops extend into the bore so as to contact the protuberance to oppose insertion of the protuberance past the second position.

4. The spark plug boot assembly of claim 3, wherein the plurality of tangs extend into the central bore so as to contact the protuberance during a forward ignition cable insertion through the central bore, and to flex outwardly toward the interior surface as the protuberance passes along the plurality of tangs during said insertion, and to snap back away from the interior surface toward the ignition cable substantially to a predetermined locking tang position when the protuberance is inserted past the first position and into the bi-directional protuberance locking position during said insertion, the locking tang position providing for engagement of the end portion of the plurality of tangs with the protuberance to oppose movement of the ignition cable in a reverse direction opposing the direction of said forward insertion through the bore.

5. The spark plug boot assembly of claim 1, wherein the body portion of the plurality of tangs extend at an angle into the central bore and toward the first position.

6. A spark plug boot assembly for receiving and securing an ignition cable having a terminal around which is secured a circumferential rib having parallel first and second circumferential rib edges, the boot assembly comprising:

a tubular boot having a central bore therethrough defined by an interior boot wall, the bore terminating, at an upper boot end, in an upper aperture for receiving the ignition cable and terminating, at a lower boot end, in a lower aperture for receiving a spark plug;

a plurality of spaced rigid bottom stops extending from the interior boot wall into the central bore and aligned about a first boot cross-section;

a plurality of spaced flexible arms, each having a base end fixedly attached to the interior boot wall and each having a flexible arm portion extending from its base end at an angle into the central bore and toward the first boot cross-section, each arm portion terminating in a flexible end opposing its corresponding base end; and each of the flexible ends of the plurality of arms aligned along a second boot cross-section spaced a predetermined distance along a longitudinal boot axis from the first boot cross-section, the predetermined distance exceeding the distance between the first and second circumferential rib edges;

thereby forming a bi-directional rib locking position between the flexible ends of the plurality of flexible arms and the plurality of bottom stops, for bi-directionally securing the ignition cable terminal in the bore.

7. The spark plug boot assembly of claim 6, wherein the tubular boot and the plurality of flexible arms are molded from a thermoplastic polyester resin material.

8. The spark plug boot assembly of claim 6, wherein the plurality of bottom stops extend into the bore so as to contact the first rib edge when the rib is inserted to the bi-directional rib locking position to oppose insertion of the rib substantially beyond the bi-directional rib locking position.

9. The spark plug boot assembly of claim 8, wherein the plurality of flexible arms extend into the central bore so as to contact the rib during a forward ignition cable insertion through the central bore, and to flex outwardly toward the interior wall as the rib passes along the plurality of flexible arms during said insertion, and to snap back away from the interior wall substantially to a predetermined locking arm position when the second rib edge is inserted past the second boot cross-section and into the bi-directional rib locking position during said insertion.

* * * * *